US006883993B2

(12) United States Patent
Malki

(10) Patent No.: US 6,883,993 B2
(45) Date of Patent: Apr. 26, 2005

(54) COMPACT TOOTHBRUSH ASSEMBLY

(76) Inventor: Abdo Malki, 1005 Pepperhill Rd., Pasadena, CA (US) 91107

( * ) Notice: Subject to any disclaimer, the term of this patent is extended or adjusted under 35 U.S.C. 154(b) by 0 days.

(21) Appl. No.: 10/609,049

(22) Filed: Jun. 27, 2003

(65) Prior Publication Data

US 2004/0265038 A1 Dec. 30, 2004

(51) Int. Cl.[7] ..... B43M 11/06; A46B 11/04
(52) U.S. Cl. ..... 401/183; 401/280; 401/281
(58) Field of Search ..... 401/281, 183–186, 401/270, 275, 280

(56) References Cited

U.S. PATENT DOCUMENTS 2,900,650 A * 8/1959 Santiago ..... 401/183
D246,878 S * 1/1978 Kitzis ..... D4/108
4,467,822 A * 8/1984 Blackwell ..... 401/175
4,482,263 A * 11/1984 Palamara ..... 401/191
4,693,622 A 9/1987 Booth
5,382,107 A 1/1995 Nian
5,439,014 A 8/1995 Moussa
5,464,294 A 11/1995 Chee et al.
5,476,334 A * 12/1995 Tello-Vallarino ..... 401/268
5,572,763 A * 11/1996 Eguchi ..... 15/167.1
5,676,167 A * 10/1997 Garner ..... 132/309
5,893,378 A * 4/1999 Llerena ..... 132/311
D435,347 S * 12/2000 Rumsey, Jr. ..... D4/108

* cited by examiner

*Primary Examiner*—David J. Walczak

(57) ABSTRACT

A compact and disposable toothbrush contains its own supply of toothpaste. The toothbrush assembly is simple, has relatively few parts and can be manufactured economically. The credit card shape of the toothbrush assembly allows it to be carried easily, for example, in a shirt pocket. The toothbrush assembly also can include other features for personal grooming including a mirror. The flat surfaces of the invention also are well suited for the printing of graphics for advertisement or other promotional uses.

18 Claims, 7 Drawing Sheets

FIG. 3
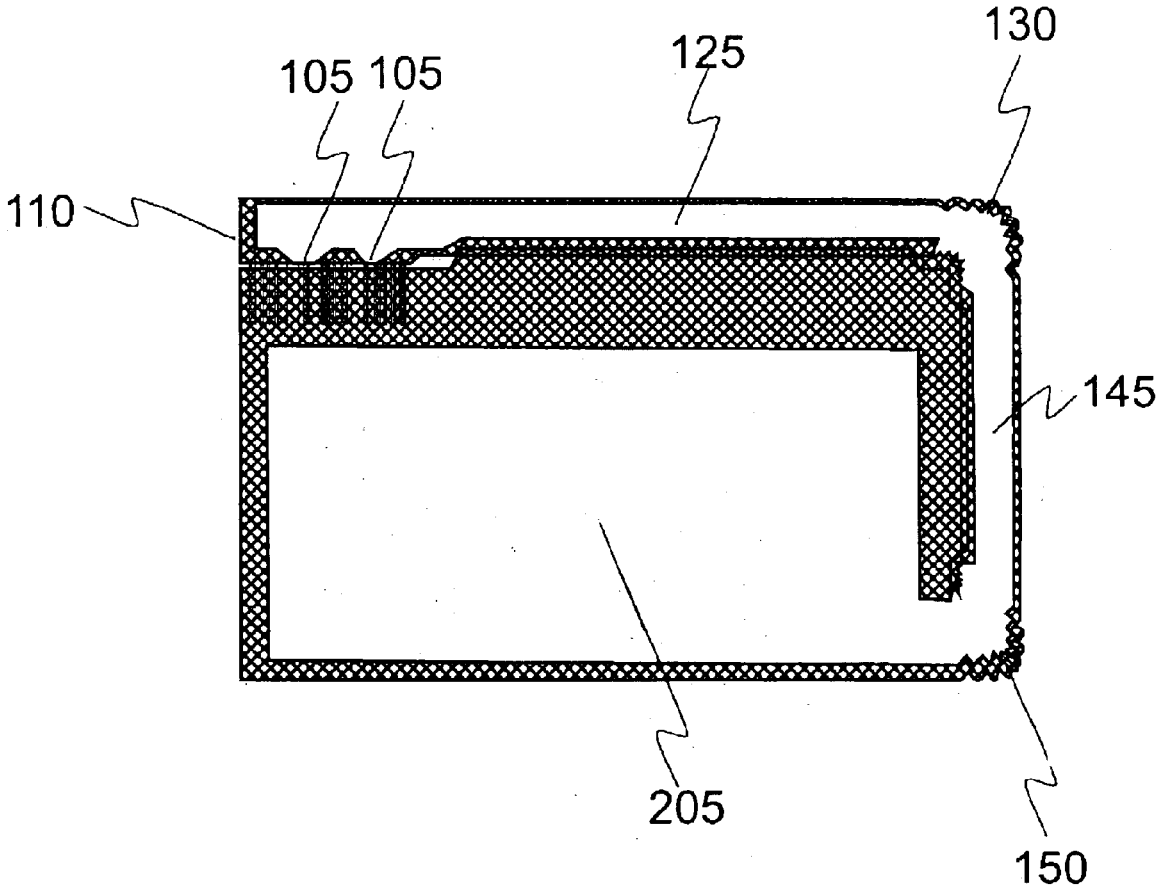
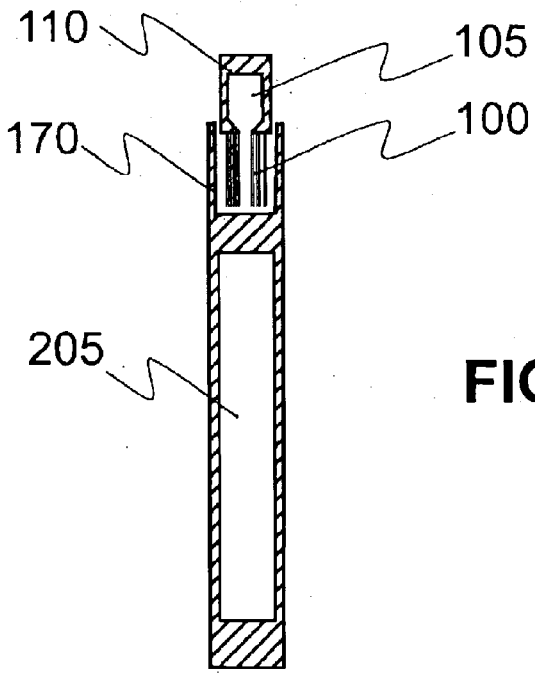
FIG. 4

COMPACT TOOTHBRUSH ASSEMBLY

FIELD OF THE INVENTION

The invention relates to a toothbrush having an integral dentrifice supply.

BACKGROUND AND SUMMARY OF THE INVENTION

A number of toothbrushes are known, including some featuring integral dentrifice supplies, including, for example, toothpaste supplies. Some toothbrush designs include those disclosed in U.S. Pat. Nos. 4,693,622; 5,382,107; 5,144,712; 4,467,822; 5,464,294; 5,476,334; and 5,439,014. However, many such toothbrushes are complex in design and therefore difficult to manufacture economically. They also have designs that may be inconvenient for travel and for carrying in a compact space, such as a pocket of an article of clothing.

There remains a need for a simple, portable toothbrush that is compact and portable and useful for travel. The invention disclosed herein provides a toothbrush and toothpaste holder that is compact, can be manufactured at sufficiently low cost to be disposable.

It is one object of the invention to provide a compact toothbrush containing its own supply of toothpaste. The combined toothbrush toothpaste dispenser can have dimensions similar to that of a credit card and have a thickness of several credit cards, allowing for placement in a shirt pocket, travel kit or other place in which space is at a premium. The toothbrush of the invention also provides other benefits including the inclusion of a mirror useful, for example, for cosmetic application. The substantially flat surfaces of the body also provide a large area suitable for printing of graphics, advertisements or other information.

In accordance with the present invention, a toothbrush assembly is provided that has a body with a reservoir disposed therein for containing a dentrifice, for example toothpaste. A hollow handle member is connected to the body such that a channel within the handle is in fluid communication with the reservoir. The connection is made through a hinge region, which included both rotatably mounted hinges and flexible hinges. The hinge can include a valving mechanism that closes the fluid connection between reservoir and handle, or can always be in the open position. The invention also can have a second handle member that is connected to the first handle member through a second hinge. The body of the toothbrush assembly is made from a pliable material that allows pressure to be applied to the reservoir to force toothpaste from the reservoir through the handle and out apertures in the brush head, allowing toothpaste to emerge at the brush head. The toothbrush assembly also can contain a dental floss holder for dispensing dental floss. Allowing a user to carry a complete dental kit in a compact and disposable package.

The toothbrush assembly of the invention can be formed from any suitable material, but for economy and disposability the assembly is most preferably formed from a plastic material. Some suitable plastics include polyethylene, polypropylene, and polystyrene.

BRIEF DESCRIPTION OF THE DRAWINGS

FIG. 3 is a longitudinal sectional view of the toothbrush.

FIG. 4 is a sectional view of a toothbrush of the invention.

DETAILED DESCRIPTION

Figure 1:
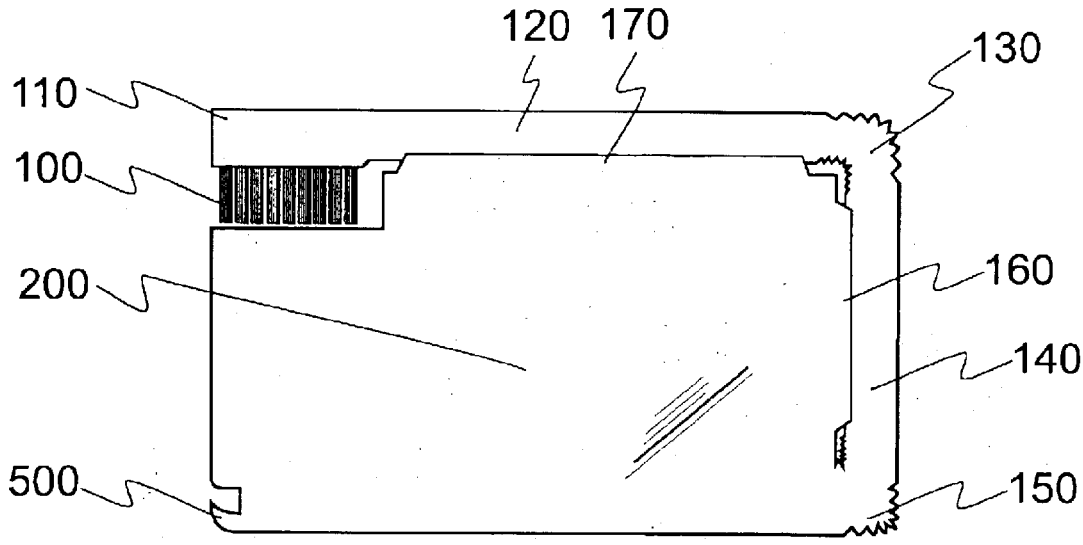
FIG. 1 is a side view of one embodiment of the invention in the folded position.

Referring to FIG. 1, FIG. 2, FIG. 3 and FIG. 4 of the drawings, the toothbrush of the invention includes a substantially rectangular body 200 having a reservoir 205 for containing a dentrifice, for example, toothpaste, disposed therein. Body 200 is attached to handle member 140 through hinge region 150. Handle member 140 has a channel 145 disposed therein in fluid communication with reservoir 205. A second handle member 120 is attached to the first handle member in this embodiment through hinge region 130, the handle member 120 having a channel 125 disposed therein in fluid communication with channel 145 through a channel disposed in hinge region 130. In the embodiment shown in FIGS. 1–4, the hinge regions are molded from the same material as body 200 and handle members 120 and 140, but have geometries and material thicknesses that allow bending from a closed to open position. The toothbrush can have an toothpick device 500 integral to body 200.

Figure 2:
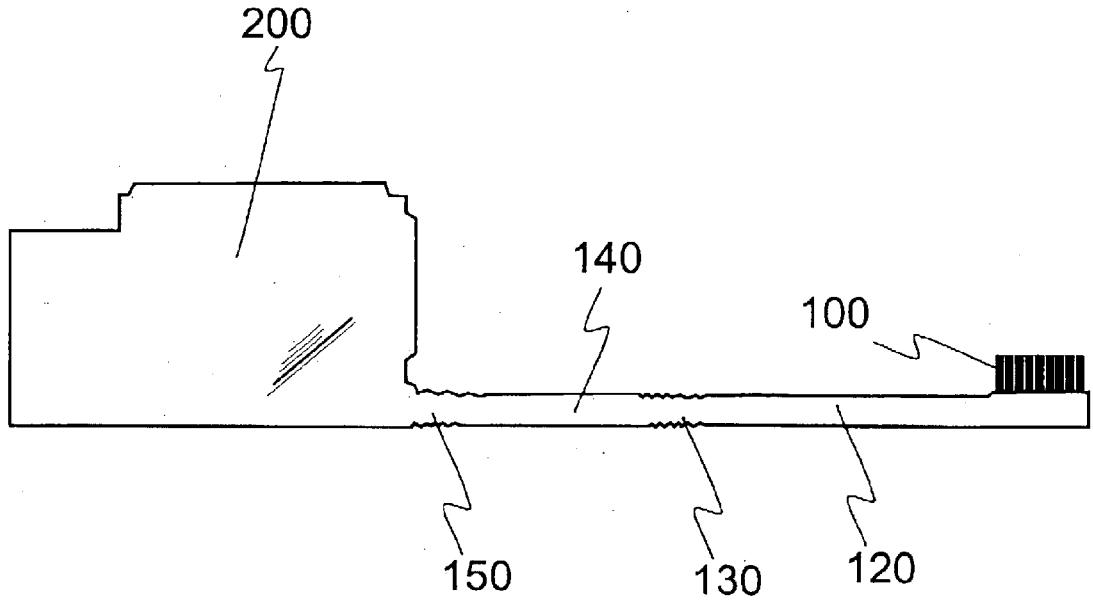
FIG. 2 is a side view of the toothbrush of FIG. 1, with the handle in an extended position.

At the distal end of the handle members from body 200, is the brush head 110, having a brushing surface attached thereto. The brushing surface can be, for example, a plurality of bristles 100. The brush head has one or more apertures 105 that connect channel 125 to the surface of the brush head to which the bristles 100 are attached. Body 200 is preferable formed of a pliable or deformable, or otherwise elastic material that allows pressure to be applied to reservoir 205, forcing toothpaste through channels 145 and 125, through aperture 105 to the brushing surface of brush head 110. The body 200 of the toothbrush can be extended to cover partially the bristles 100 and/or the handle members 140 and 120. In FIG. 1 and FIG. 2, body extension 160 extends over handle member 140, holding it in a closed position, and body extension 170 extends over handle member 120, holding it in a closed position. The body extensions preferably engage the handle members through friction to hold the handle members firmly in place. As shown in FIG. 3 and FIG. 4, the body extension 170 also can extend to form a cavity for guarding the brush head cleaning surface and bristles 100.

Figure 5:
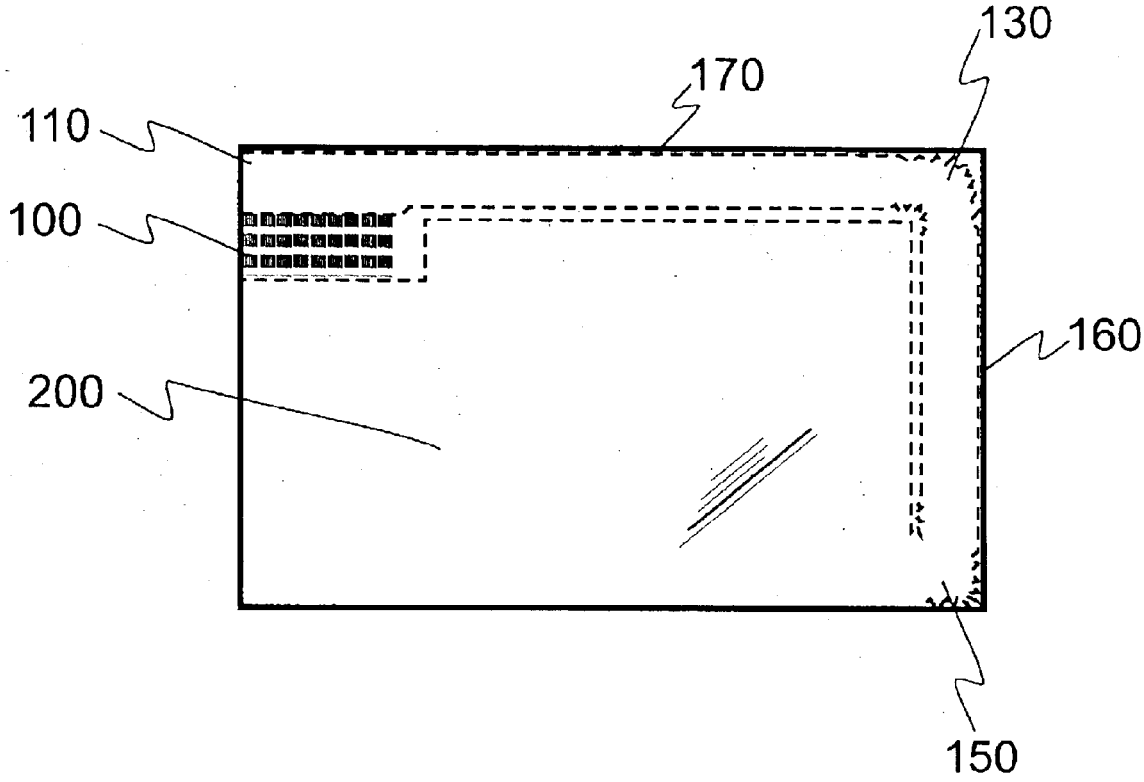
FIG. 5 is a side view showing a toothbrush of the invention in the closed position.
Figure 6:
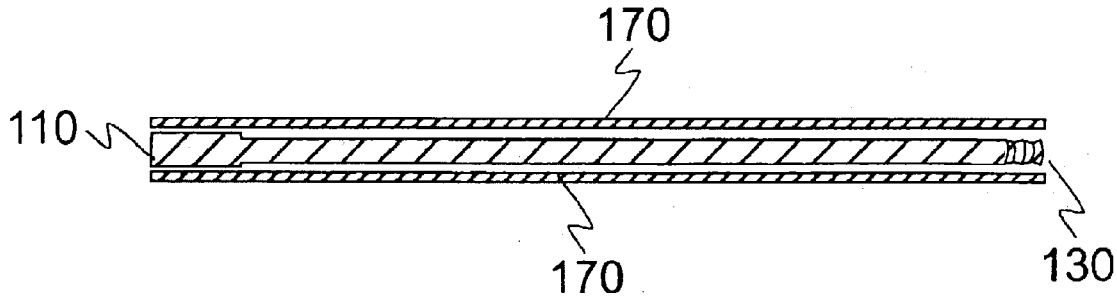
FIG. 6 is a top view of the toothbrush in FIG. 5.

FIG. 5 and FIG. 6 show a similar embodiment in which body extensions 160 and 170 extend to cover handle members 120 and 140, thus providing a compact package having substantially rectangular front and back sides.

The rectangular shape of the toothbrush of the invention makes it particularly well suited for use as a mirror. One or both surfaces can be coated with a reflective material, for example a metal foil, to provide a reflective surface. The general size of the apparatus also is well suited to the application of promotional graphics. The general dimensions of the toothbrush are similar to that of a standard credit card (about 5.4 cm by about 8.5 cm) although a bit thicker. The toothbrush in the folded position has dimensions of about 4.5 cm to about 6 cm by about 7.5 to about 9.5 cm by about 0.20 cm to about 0.75 cm. Such a size is well suited to the display of graphics such as would normally be found on a business card, enabling use of the toothbrush as a promotional give away. The flat surface of the body 200 also is well suited to standard and inexpensive printing techniques.

Figure 7:
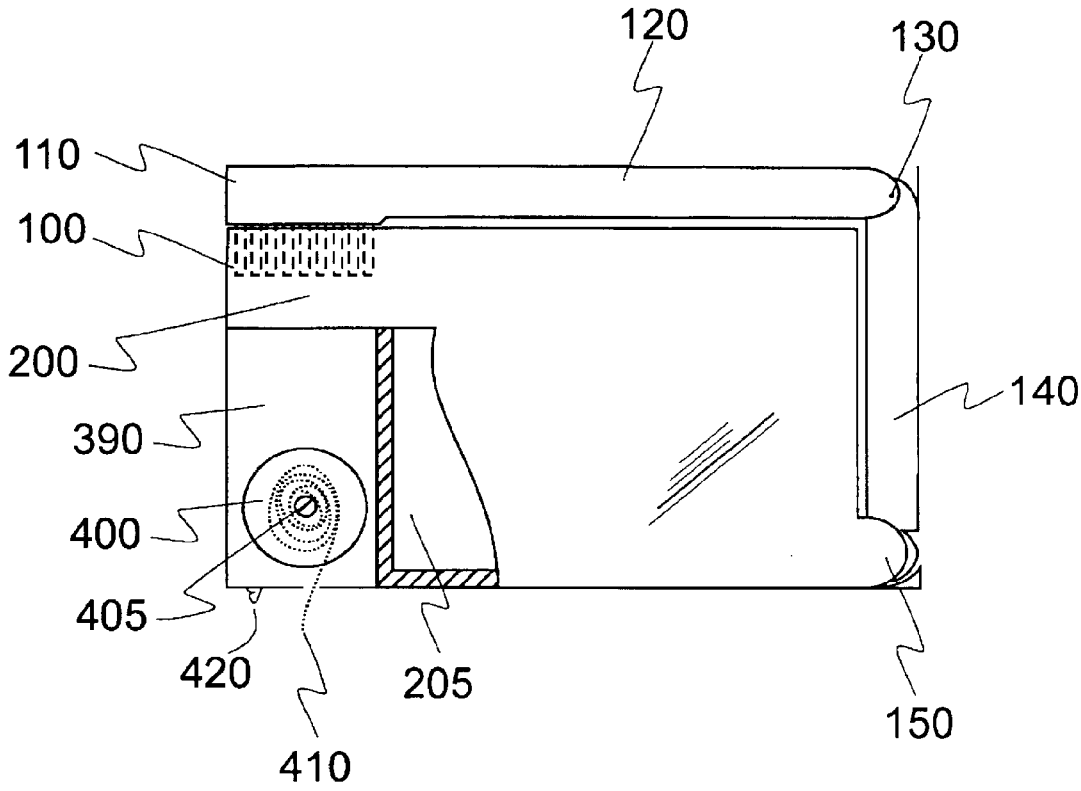
FIG. 7 is a side view with a partial sectional view, showing a toothbrush of the invention having hinges.
Figure 8:
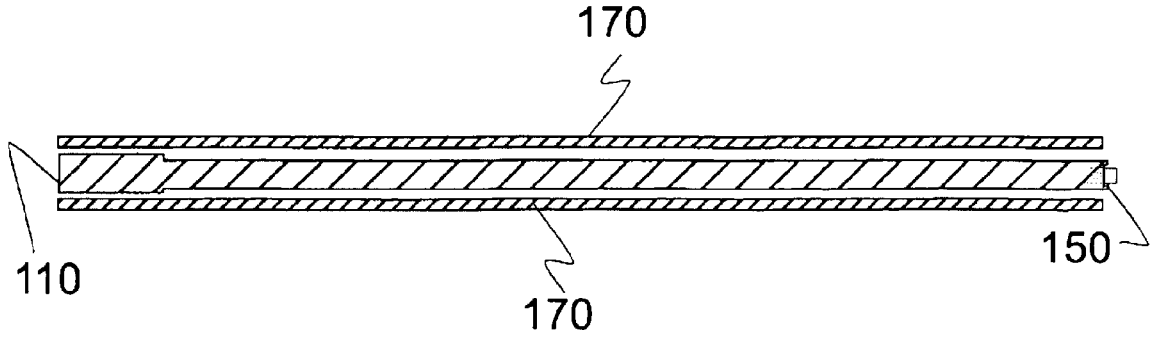
FIG. 8 is a top view of the toothbrush in FIG. 7.

FIG. 7 shows an embodiment of the toothbrush in which the body 200, handle member 140, and handle member 120 are separate pieces linked through hinges 130 and 150. FIG. 7 includes a spool 400 rotatably mounted within a cavity 390 in the body for holding dental floss 410. The spool can rest on protrusion or protrusions from the body 405, allowing it to spin freely. An aperture is provided to allow the dental floss to exit the body. For convenience, a dental floss cutter 420 can be included on the exterior of the body. The cutter can be fabricated from any suitable material, but preferably contains a metal, ceramic or other hard and sharp material for cutting the dental floss. In another embodiment, dental floss is provided within a cavity in the body, but is not wound on a spool. The floss can be pulled through the aperture in the body wall and cut. When the product is shipped, it is preferable to secure the floss with a small piece of adhesive tape to allow the free end to remain accessible to the user. The floss also can be supplied in a number of pre-cut pieces or pieces that have been at least partially cut to allow their removal from the device without the necessity to cut it. Cavity 390 or an additional cavity can be provided for holding and dispensing a liquid dentrifice, including, for example, mouthwash. In such an embodiment, the aperture provided will include a means for sealing the aperture to provide a substantially leak-proof container. One such means is an adhesive tab. As the device can be manufactured to be disposable, the tab can be made so the user can remove the adhesive tab for a single use. Other suitable means include any variety of plugs, including threaded and non-threaded plugs.

Figure 9:
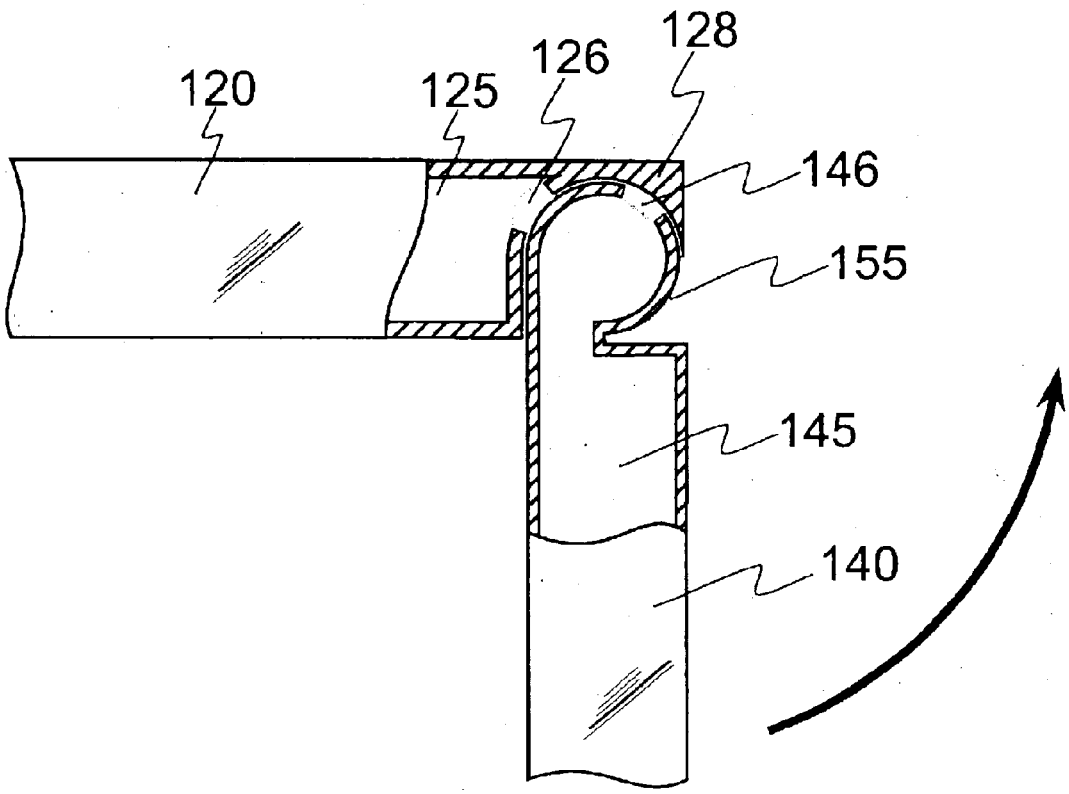
FIG. 9 is a side view, partially sectional, of a hinge in a closed position.
Figure 10:
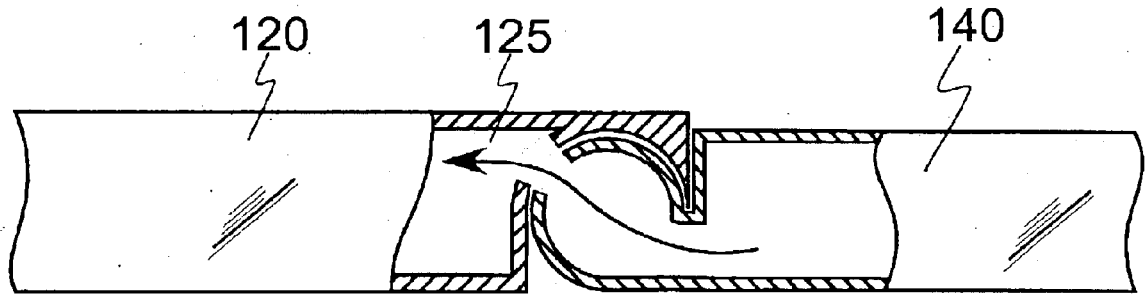
FIG. 10 is a side view, partially sectional, of a hinge in an extended position.

In such an embodiment, the hinges also can serve as valves, preventing flow of toothpaste through the channels 125 and 145. Hollow convex end 155 of handle member 140 fits into concave end 128 of handle member 120. In the closed position (FIG. 9), aperture 146 in convex end 155 opens against concave end 128, blocking fluid communication between channel 145 and channel 125. In the open position (FIG. 10), aperture 146 is aligned with aperture 126 in concave end 128, bringing channels 145 and 125 into fluid communication.

Figure 11:
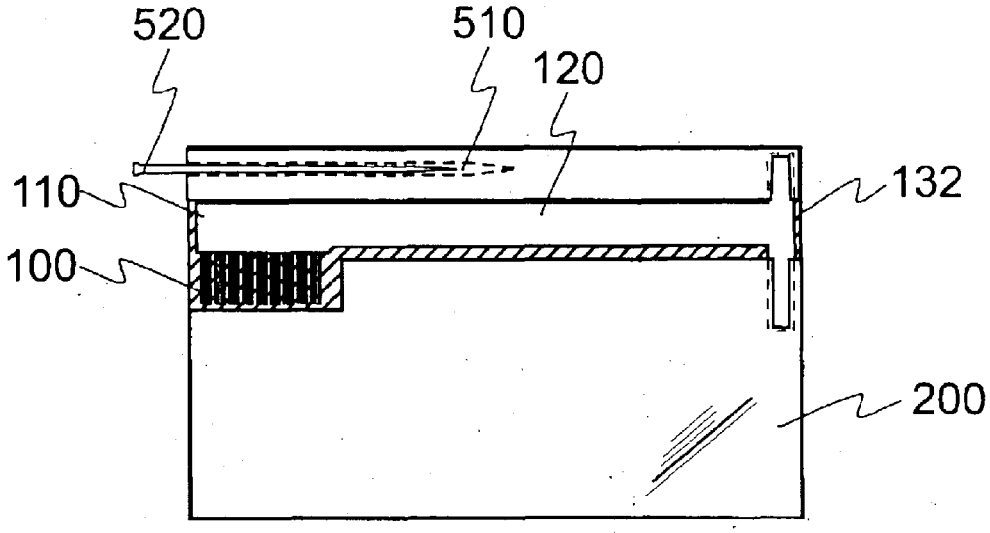
FIG. 11 is a side view of a toothbrush having a single hinge.
Figure 12:
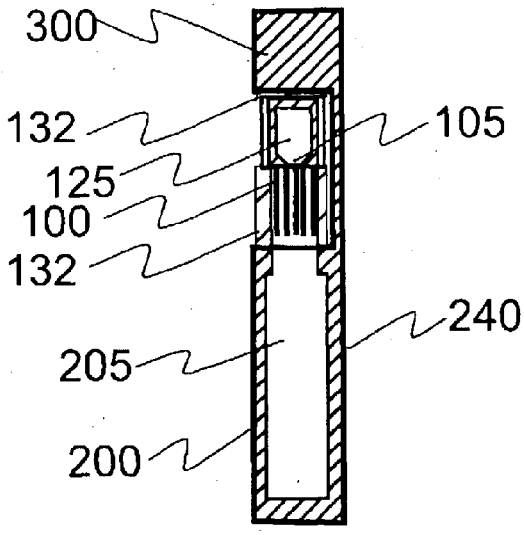
FIG. 12 is a transverse sectional view of the toothbrush in FIG. 11.
Figure 13:
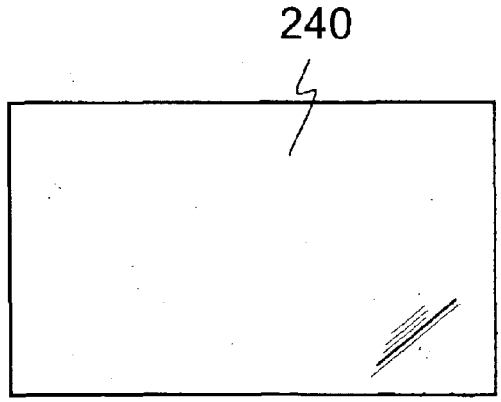
FIG. 13 is a back side view of a toothbrush of the invention.
Figure 14:
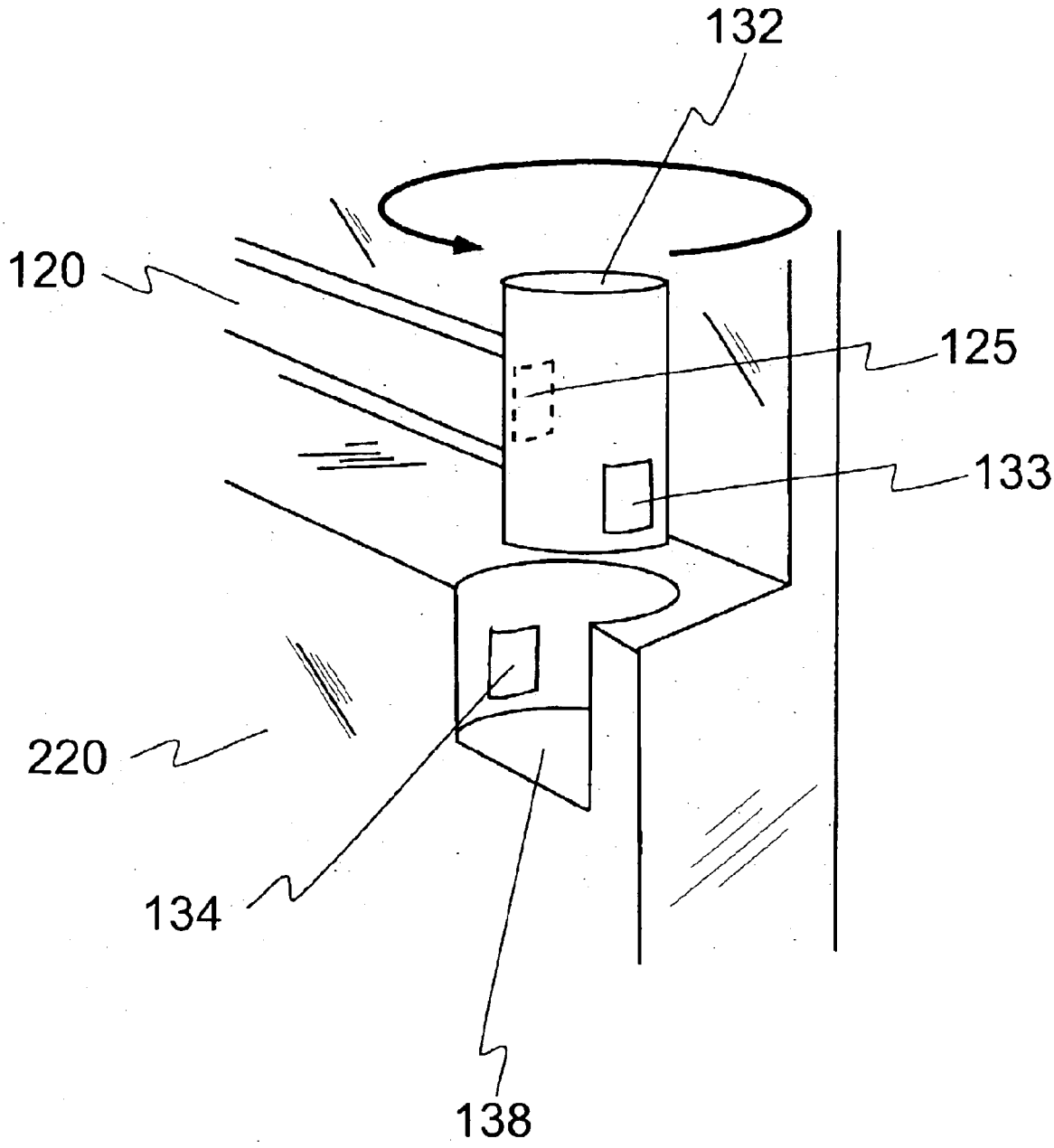
FIG. 14 is an exploded view of a hinge region of a toothbrush of the invention.

Another embodiment of the invention is shown in FIG. 11, FIG. 12, FIG. 13, and FIG. 14. In such an embodiment, single handle member 120 is attached to body 200, through a hinge mechanism 132. The body 200, upper body 300 and handle 120 collapse to give a substantially flat package. Back surface 240 of the body is substantially flat and suited for coating with a reflective material as is the front surface of body 200. Graphics, text or other promotional material can be printed on either or both the front and back surfaces. FIG. 14 shows an exploded view of a binge suitable for use with the toothbrush shown in FIG. 11–13. Hollow hinge member 132 connects channel 125 to reservoir 205 through apertures 133 and 134. Hinge member 132 sits in hinge seat 138 and can rotate from a closed position in which handle member lies in a groove lying between body 200 and upper body 300. In the extended or open position, aperture 133 is aligned with aperture 134, allowing flow of toothpaste from reservoir 205 through hollow hinge member 132, through channel 125 disposed in handle member 120, allowing paste to exit aperture 105 in brush head 110. FIG. 11 also shows a toothbrush having a recess 510 disposed within body 300 that can hold a toothpick 520. In this embodiment, the toothpick is removable and locks in place by a simple friction fit; however, the toothpick could also be slidably engaged with the pointed side outward, and not be removable. In such an embodiment, the recess could form an open channel in body 200 and the toothpick could include a protrusion that allowed deployment of the toothpick from the closed position to an open position.

I claim:

1. A toothbrush assembly comprising:

a body, having a reservoir disposed therein;

a first handle member attached to the body through a first hinge, wherein the first handle member has a first channel disposed therein, the first channel in fluid communication with the reservoir, the first handle having a closed position and an extended position;

a second handle member attached to the first handle member through a second hinge and attached to the body through the first hinge, wherein the second handle member has a second channel disposed therein, the second channel in fluid communication with the reservoir and the first channel region, a brush head on the first handle member having a brushing surface attached thereto, wherein the brush head has at least one aperture opening into the first channel on the same surface as the brushing surface;

wherein the toothbrush can be folded to assume a compact rectangular form; and wherein the body is formed of a pliable material so that pressure on the body forces toothpaste through the aperture on the brush head.

2. The toothbrush of claim 1, wherein the brushing surface is formed by a plurality of bristles attached to the first handle member.

3. The toothbrush of claim 1, wherein the reservoir contains toothpaste.

4. The toothbrush of claim 1, wherein the body has at least one flat surface.

5. The toothbrush of claim 4, wherein the surface is suitable for printing of graphics.

6. The toothbrush of claim 4, wherein the at least one flat surface is reflective.

7. The toothbrush of claim 4, wherein the body has a second substantially flat surface, wherein the second is suitable for printing of graphics.

8. The toothbrush of claim 1, wherein the hinge serves as a valve, closed in the folded position and open when the handle is extended away from the body.

9. The toothbrush of claim 1, further comprising a mechanism for holding the toothbrush in the closed position.

10. The toothbrush of claim 1, wherein the toothbrush in the folded position has dimensions of about 4.5 cm to about 6 cm by about 7.5 to about 9.5 cm by about 0.20 cm to about 0.75 cm.

11. The toothbrush of claim 1, wherein the body and handle members are formed of plastic.

12. The toothbrush of claim 1, wherein the body further comprises a cavity for holding dental floss.

13. The toothbrush of claim 12, further comprising a spool rotatably mounted within the body for holding the dental floss.

14. The toothbrush of claim 12, further comprising a cutter attached to the body to cut dental floss.

15. The toothbrush of claim 1, further comprising a toothpick integral with and extending from the body.

16. The toothbrush of claim 15, wherein the toothpick is slidably engaged in the recess.

17. The toothbrush of claim 1, further comprising a recess in the body for holding an elongate toothpick.

18. The toothbrush of claim 1, further comprising a second reservoir disposed within the body for holding a liquid dentrifice and an aperture in the body and a means for closing the aperture so that it is substantially leak proof.

* * * * *